US010974522B2

(12) United States Patent
Ikegami

(10) Patent No.: US 10,974,522 B2
(45) Date of Patent: Apr. 13, 2021

(54) LIQUID DISCHARGE APPARATUS, DYEING APPARATUS, AND HEAD DRIVE METHOD

(71) Applicant: Kohtaroh Ikegami, Kanagawa (JP)

(72) Inventor: Kohtaroh Ikegami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/576,773

(22) Filed: Sep. 20, 2019

(65) Prior Publication Data

US 2020/0207117 A1 Jul. 2, 2020

(30) Foreign Application Priority Data

Dec. 28, 2018 (JP) ..... JP2018-248080

(51) Int. Cl.

| | |
|---|---|
| ***B41J 3/407*** | (2006.01) |
| ***B41J 2/045*** | (2006.01) |
| ***D06P 5/00*** | (2006.01) |

(52) U.S. Cl.

CPC ..... *B41J 3/4078* (2013.01); *B41J 2/04573* (2013.01); *B41J 2/04581* (2013.01); *B41J 2/04588* (2013.01); *D06P 5/00* (2013.01)

(58) Field of Classification Search

CPC .. B41J 3/4078; B41J 2/04581; B41J 2/04588; B41J 2/04573; D06P 5/00

See application file for complete search history.

(56) References Cited

U.S. PATENT DOCUMENTS

| | | | |
|---|---|---|---|
| 2008/0117245 | A1 | 5/2008 | Nishimura |
| 2009/0147034 | A1 | 6/2009 | Yoshida |
| 2016/0067959 | A1 | 3/2016 | Zhang |

FOREIGN PATENT DOCUMENTS

| | | |
|---|---|---|
| JP | 2008-001084 | 1/2008 |
| JP | 2013-132752 | 7/2013 |
| JP | 2018-526540 | 9/2018 |
| WO | WO2016/204686 A1 | 12/2016 |

OTHER PUBLICATIONS

IP.com search (Year: 2020).*

Extended European Search Report dated Mar. 20, 2020, issued in corresponding European Patent Application No. 19197152.2, 8 pages.

* cited by examiner

*Primary Examiner* — Lisa Solomon

(74) *Attorney, Agent, or Firm* — Xsensus LLP

(57) ABSTRACT

A liquid discharge apparatus includes a head including a row of a plurality of nozzles configured to discharge a liquid. The liquid discharge apparatus further includes circuitry configured to generate a discharge timing in accordance with movement of a linear object to which the head applies the liquid, apply a drive waveform to the head based on the discharge timing, and apply a micro vibrating pulse to the head after application of a discharge pulse for discharging the liquid and before a subsequent discharge timing. The micro vibrating pulse is for vibrating a meniscus of the nozzle.

7 Claims, 6 Drawing Sheets

FIG. 6

| | DECAPPING TIME [sec] | DRIVE FREQUENCY [Hz] | | | | | |
|---|---|---|---|---|---|---|---|
| | | – | 500 | 1000 | 2500 | 5000 | 10000 |
| TEMPERATURE : 25°C HUMIDITY : 40% | 5 | 2 | 3 | 3 | | 3 | |
| | 15 | 1 | 3 | 3 | | 3 | |
| | 30 | 1 | 3 | 3 | 3 | 3 | |
| | 60 | 1 | 2 | 3 | 3 | 3 | |
| | 90 | | | 3 | 3 | 3 | |
| | 120 | | | 2 | 2 | 3 | |
| | 180 | | | 1 | | 3 | |
| | 240 | | | 1 | | 3 | 3 |
| | 300 | | | | | 2 | 3 |
| | 360 | | | | | 1 | 3 |
| TEMPERATURE : 39°C HUMIDITY : 28% | 5 | | | 3 | 3 | | |
| | 15 | | | 2 | 3 | | |
| | 30 | | | 2 | 3 | 3 | |
| | 60 | | | 1 | 2 | 3 | |
| | 90 | | | | | 3 | 3 |
| | 120 | | | | | 2 | 3 |
| | 180 | | | | | 2 | 2 |
| | 240 | | | | | | 1 |
| | 300 | | | | | | |
| | 360 | | | | | | |

LIQUID DISCHARGE APPARATUS, DYEING APPARATUS, AND HEAD DRIVE METHOD

CROSS-REFERENCE TO RELATED APPLICATION

This patent application is based on and claims priority pursuant to 35 U.S.C. § 119(a) to Japanese Patent Application No. 2018-248080, filed on Dec. 28, 2018, in the Japan Patent Office, the entire disclosure of which is hereby incorporated by reference herein.

BACKGROUND

Technical Field

The present disclosure relates to a liquid discharge apparatus, a dyeing apparatus, and a head driving method.

Description of the Related Art

For example, in a known method, a discharge timing is generated based on the amount of movement of a carriage on which a head is mounted and the amount of movement of a medium to Which liquid is applied, and a discharge pulse is applied to the head with reference to the discharge timing. In addition, a drive waveform can include a Micro vibrating pulse (non-discharge drive pulse) that slightly drives a pressure generating element to an extent that the liquid is not discharged from a nozzle, and the micro vibrating pulse is applied to the nozzle that is not to discharge the liquid.

Meanwhile, there are devices, such as embroidery machines, that feed thread from a thread supplying device and discharges liquid to the thread that is moving, to color the thread. In such an embroidery machine, the thread runs through a treatment section to an embroidery head, and embroidery is performed while the thread is colored.

SUMMARY

According to an embodiment of this disclosure, a liquid discharge apparatus includes a head including a row of a plurality of nozzles configured to discharge a liquid. The liquid discharge apparatus further includes circuitry configured to generate a discharge timing in accordance with movement of a linear object to which the head applies the liquid, apply a drive waveform to the head based on the discharge timing, and apply a micro vibrating pulse to the head after application of a discharge pulse for discharging the liquid and before a subsequent discharge timing. The micro vibrating pulse is for vibrating a meniscus of the nozzle.

According to another embodiment, a dyeing apparatus includes the head and the circuitry described above.

Another embodiment provides a method for applying a drive waveform to a head including a row of a plurality of nozzles for discharging a liquid. The method includes generating a discharge timing in accordance with movement of a linear object to which the head applies the liquid, applying a drive waveform to the head based on the discharge timing, and applying a micro vibrating pulse to the head after application of a discharge pulse for discharging the liquid and before a subsequent discharge timing. The micro vibrating pulse is for vibrating a meniscus of the nozzle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6 is a table illustrating an example of relationship between decapping time of a nozzle face of the head illustrated in FIG. 3 and discharge stability in accordance with micro vibration frequencies.

Figure 1:
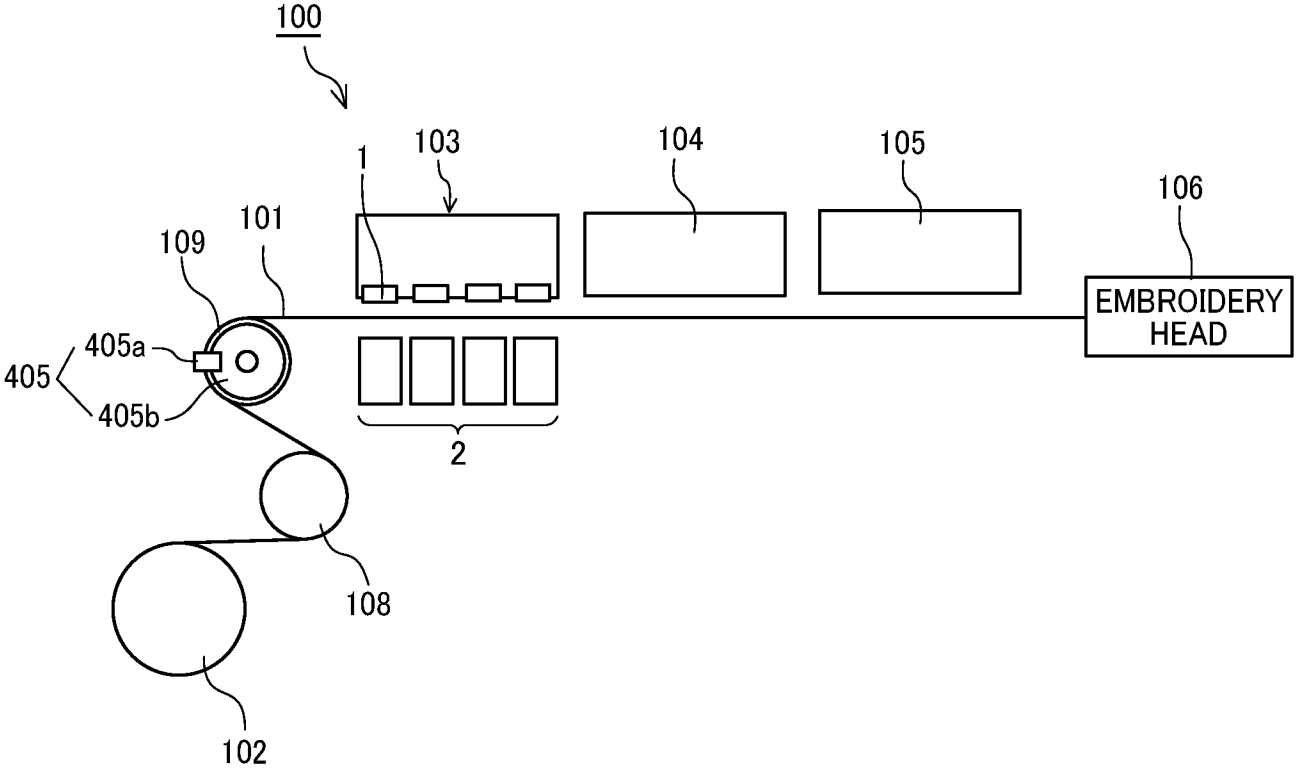
FIG. 1 is a schematic side view of a liquid discharge apparatus according to the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a liquid discharge apparatus according to an embodiment of this disclosure is described. As used herein, the singular forms "a", "an", and "the" are intended to include the plural forms as well, unless the context clearly indicates otherwise.

Figure 2:
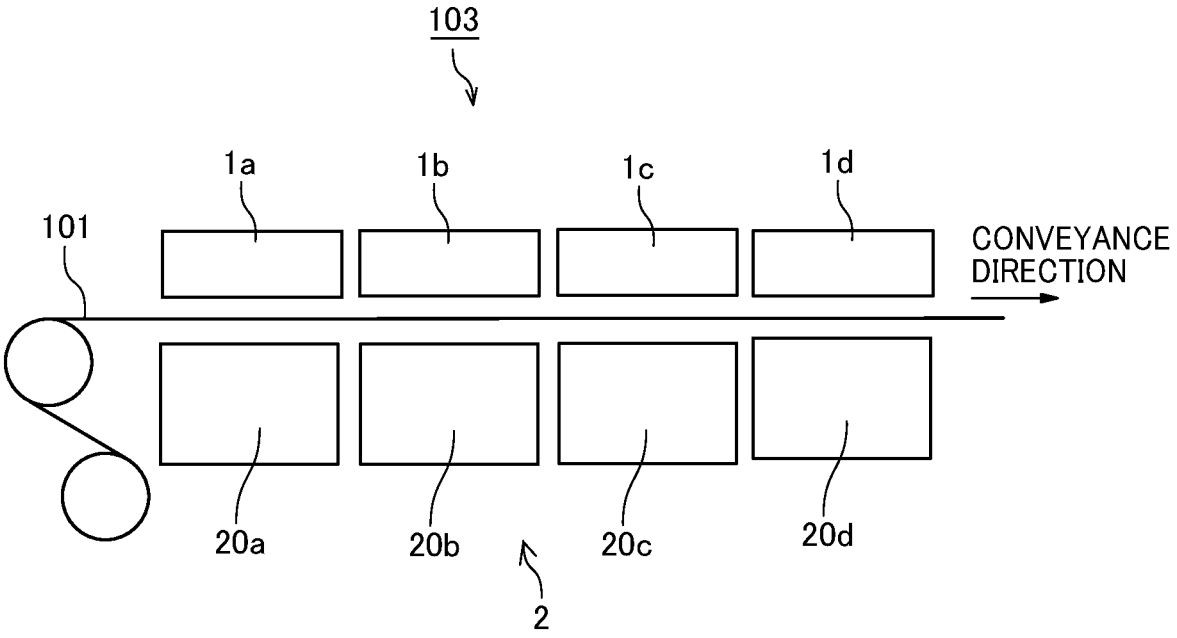
FIG. 2 is a schematic view of a liquid application unit of the liquid discharge apparatus illustrated in FIG. 1.
Figure 3:
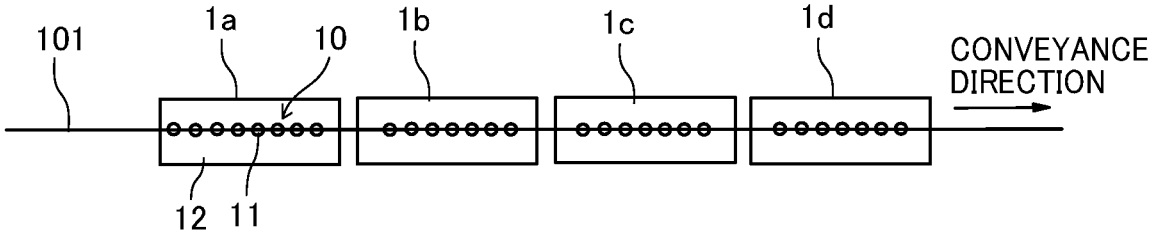
FIG. 3 is a plan view of a row of heads of the liquid application unit illustrated in FIG. 2, as viewed from below.

FIG. 1 is a schematic view of a liquid discharge apparatus 100. FIG. 2 is a view of a liquid application unit of the liquid discharge apparatus 100. FIG. 3 is a view of a row of heads of the liquid application unit as viewed from below.

The liquid discharge apparatus 100 is an in-line embroidery machine. The liquid discharge apparatus 100 includes a supply reel 102 on which a thread 101 is wound, a liquid application unit 103, a fixing unit 104, a post-processing unit 105, and an embroidery head 106.

The thread 101 drawn from the supply reel 102 is guided by rollers 108 and 109 and continuously stretched to the embroidery head 106.

The liquid application unit 103 includes a plurality of heads 1 (1*a* to 1*d*), serving as liquid discharge devices, and a maintenance unit 2. The liquid application unit 103 discharges a liquid of a required color onto the thread 101 which is drawn out from the supply reel 102. The maintenance unit 2 incudes a plurality of individual maintenance units 20 (20*a* to 20*d*) to perform maintenance of the heads 1, respectively. The heads 1*a* to 1*d* discharge, for example, cyan (C), magenta (M), yellow (Y) and black (K) color liquids.

As illustrated in FIG. 3, each of the heads 1 (1*a* to 1*d*) includes a nozzle plate in which a plurality of nozzles 11 to discharge a liquid is formed. Specifically, on a face (hereinafter "nozzle face 12") of the nozzle plate, the plurality of nozzles 11 is lined in a nozzle row 10. Each head 1 is disposed such that the nozzle row 10 is oriented in (arrangement of the nozzles 11 matches) the direction of conveyance of the thread 101.

The fixing unit 104 performs a fixing process (drying process) of the thread 101 to which the liquid is applied from the liquid application unit 103. The fixing unit 104 includes, for example, a heater such as an infrared irradiation device and a hot air sprayer, and heats the thread 101 to dry.

The post-processing unit 105 includes, for example, a cleaning device that cleans the thread 101, a tension adjustment device that adjusts the tension of the thread 101, a feed amount detector that detects the amount of movement of the thread 101, and a lubricant application device that lubricates the surface of the thread 101.

The embroidery head 106 embroiders a pattern, for example, on a cloth with the thread 101.

Although the liquid discharge apparatus in the present embodiment is an embroidery machine, the present disclosure is not limited thereto. Aspects of the present disclosure are applicable to devices, such as weaving machines and sewing machines, that use linear objects such as threads. In addition, aspects of the present disclosure are applicable to apparatuses that print images on general sheet materials. Further, aspects of the present disclosure can be applied not only to apparatuses having a post-process, such as an embroidery machine, but also to dyeing apparatuses and the like that dye and wind threads, etc. as described later.

Further, "thread" includes glass fiber thread, wool thread, cotton thread, synthetic thread, metal thread, wool, cotton, polymer, mixed metal thread, yarn, filament, and linear objects (continuous base materials) to which liquid is applicable. Thus, the "thread" also includes braids and flat cords (flat braids).

The liquid discharge apparatus 100 can include a controller configured similar to a general-purpose computer constructed of, for example, a central processing unit (CPU), a field-programmable gate array (FPGA), a random access memory (RAM), and a read only memory (ROM). For example, the CPU uses the RAM as a work area to execute various control programs stored on the ROM in order to control the operation of the liquid discharge apparatus 100.

Figure 4:
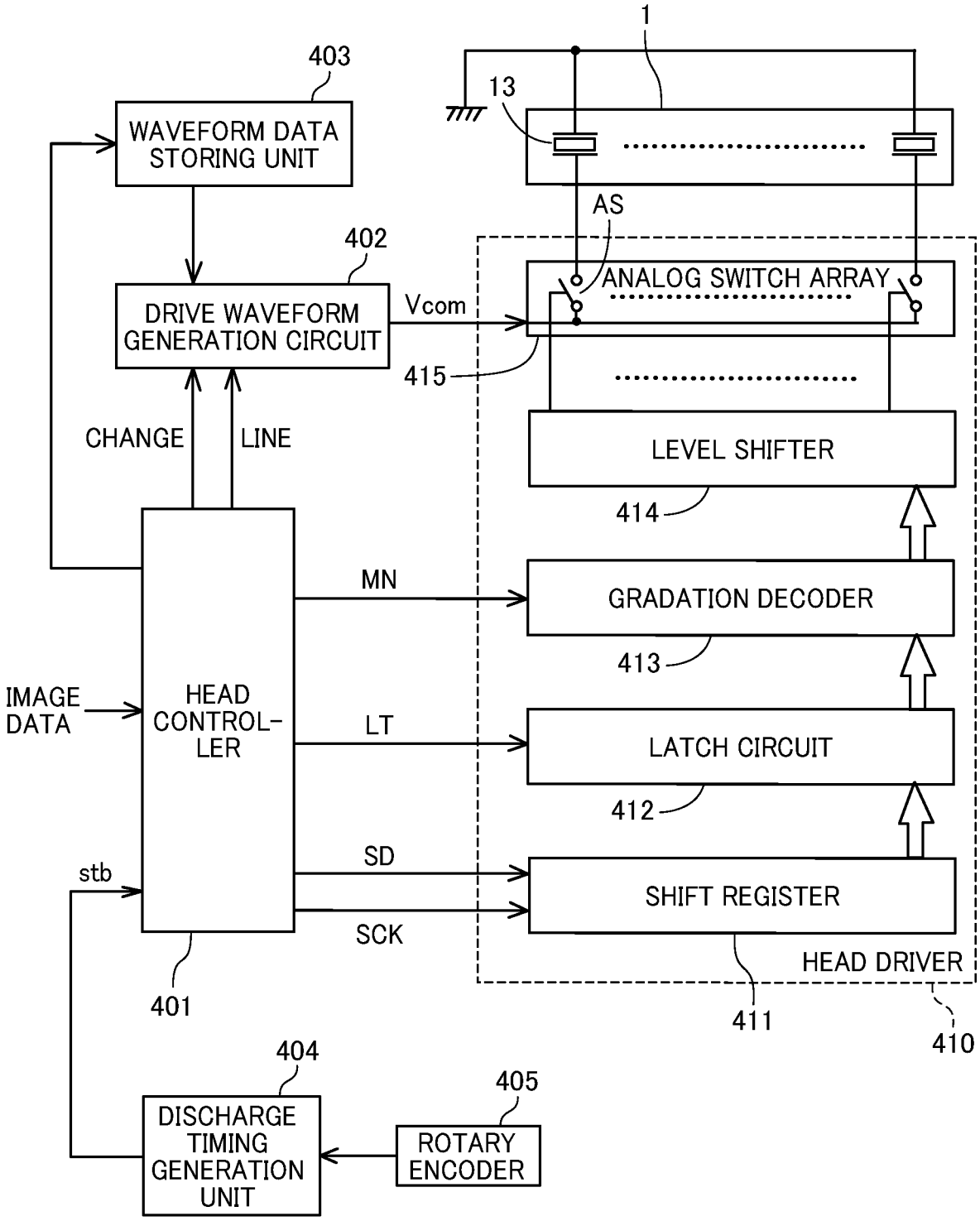
FIG. 4 is a block diagram illustrating components related to drive waveform application according to an embodiment of the present disclosure.

Next, a configuration for drive waveform application according to the present embodiment is described with reference to FIG. 4. FIG. 4 is a block diagram illustrating components related to a drive waveform application unit according to the present embodiment.

The head 1 includes a plurality of piezoelectric elements 13 as pressure generating elements that generate pressure for discharging the liquid from the plurality of nozzles 11.

The drive waveform application unit to apply a drive waveform to the head 1 is implemented by a head controller 401, a drive waveform generation circuit 402, a waveform data storing unit 403, a head driver 410, and a discharge timing generation unit 404 to generate a discharge timing.

In response to a reception of a discharge timing pulse stb, the head controller 401 outputs a discharge synchronization signal LINE that triggers generation of the drive waveform, to the drive waveform generation circuit 402. Further, the head controller 401 outputs a discharge timing signal CHANGE equivalent to the amount of delay from the discharge synchronization signal LINE, to the drive waveform generation circuit 402.

The drive waveform generation circuit 402 generates a common drive waveform signal Vcom at the timing based on the discharge synchronization signal LINE and the discharge timing signal CHANGE.

The head controller 401 receives image data and generates a mask control signal MN based on the image data. The mask control signal MN is for selecting a waveform of the common drive waveform signal Vcom according to the size of the liquid droplet to be discharged from each nozzle 11 of the head 1. The mask control signal MN is a signal at a timing synchronized with the discharge timing signal CHANGE.

Then, the head controller 401 transmits image data SD, a synchronization clock signal SCK, a latch signal LT instructing latch of the image data, and the generated mask control signal MN to the head driver 410.

The head driver 410 includes a shift register 411, a latch circuit 412, a gradation decoder 413, a level shifter 414, and an analog switch array 415.

The shift register 411 receives the image data SD and the synchronization clock signal SCK transmitted from the head controller 401. The latch circuit 412 latches each value on the shift register 411 according to the latch signal LT transmitted from the head controller 401.

The gradation decoder 413 decodes the value (image data SD) latched by the latch circuit 412 and the mask control signal MN and outputs the result. The level shifter 414 performs level conversion of a logic level voltage signal of the gradation decoder 413 to a level at which the analog switch AS of the analog switch array 415 can operate.

The analog switch AS of the analog switch array 415 is turned on and off by the output received from the gradation decoder 413 via the level shifter 414. The analog switch AS is provided for each nozzle 11 of the head 1 and is connected to an individual electrode of the piezoelectric element 13 corresponding to each nozzle 11. In addition, to the analog switch AS, the common drive waveform signal Vcom from the drive waveform generation circuit 402 is input. In addition, as described above, the timing of the mask control signal MN is synchronized with the timing of the common drive waveform signal Vcom.

Therefore, the analog switch AS is switched between on and off timely in accordance with the output from the gradation decoder 413 via the level shifter 414. With this operation, the waveform to be applied to the piezoelectric element 13 corresponding to each nozzle 11 is selected from the drive waveforms forming the common drive waveform signal Vcom. As a result, the size of the liquid droplet discharged from the nozzle is controlled.

The discharge timing generation unit 404 generates and outputs the discharge timing pulse stb each time the thread 101 is moved by a predetermined amount, based on the detection result of a rotary encoder 405 that detects the rotation amount of the roller 109 illustrated in FIG. 1. The predetermined amount of movement of the thread 101 can be empirically obtained and stored in a memory. The rotary encoder 405 includes an encoder wheel 405*a* that rotates together with the roller 109 and an encoder sensor 405*b* that reads a slit of the encoder wheel 405*a*.

The thread 101 is conveyed (moved) as consumed in the embroidery operation by the embroidery head 106 on the downstream side in the conveyance direction of the thread 101. As the thread 101 is conveyed, the roller 109 guiding the thread 101 rotates to rotate the encoder wheel 405*a* of the rotary encoder 405. Then, the encoder sensor 405*b* generates and outputs an encoder pulse proportional to the linear speed of the thread 101.

The discharge timing generation unit 404 generates the discharge timing pulse stb based on the encoder pulse from the rotary encoder 405. The discharge timing pulse stb is used as the discharge timing of the head 1. The application of the liquid to the thread 101 is started as the thread 101 starts moving. Even if the linear speed of the thread 101 changes, deviations in the landing position of the droplets can be prevented because the interval of the discharge timing pulse stb changes according to the encoder pulse.

Figure 5:
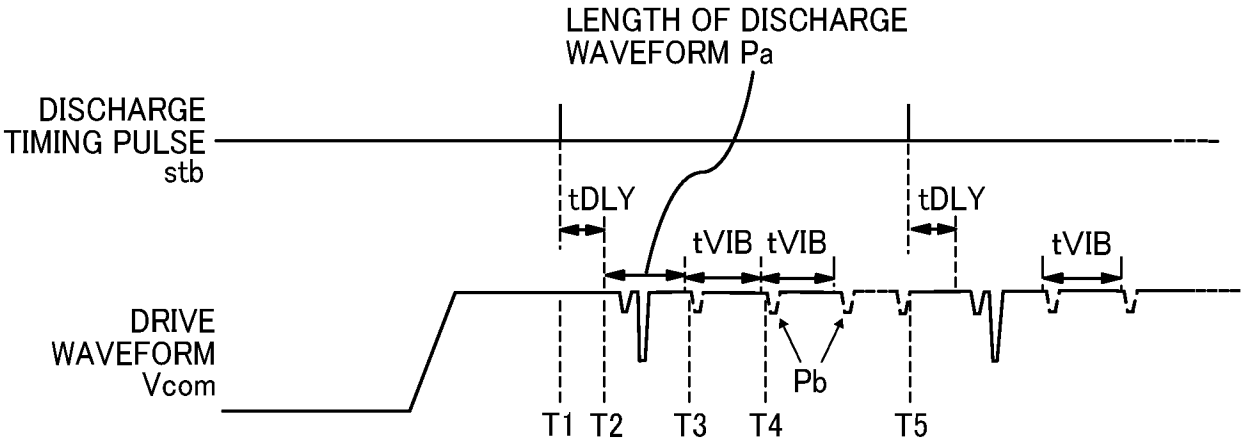
FIG. 5 is a timing chart of a discharge timing pulse and a drive waveform generated in the configuration illustrated in FIG. 4.

Next, drive waveforms according to the present embodiment is described with reference to FIG. 5. FIG. 5 is a timing chart o the discharge timing pulse and the drive waveform.

With reference to the discharge timing pulse stb from the discharge timing generation unit 404 illustrated in FIG. 5, a discharge pulse Pa (a discharge waveform) for discharging the liquid is generated in the drive waveform. Specifically, the discharge pulse Pa is applied to the head 1 at a timing T2 delayed by a time tDLY from when the discharge timing pulse stb is input at a timing T1.

Then, at a timing T4 after elapse of a micro vibration cycle tVIB (time interval) completion (a timing T3) of the application of the discharge pulse Pa for the entire wavelength thereof, application of a micro vibrating pulse Ph (micro-vibration drive waveform) is started. The micro vibrating pulse Pa is a drive pulse for vibrating the meniscus of the nozzle 11 to such an extent that the liquid is not discharged.

The micro vibration operation for applying the micro vibrating pulse Pb is repeated at a predetermined micro vibration cycle (predetermined time interval) tVIB until a subsequent discharge timing pulse stb synchronized with the encoder pulse is generated (at timing T5) or the drive waveform Vcom is stewed down. The predetermined time interval can be empirically obtained and stored in a memory.

In a case where the micro vibrating pulse Pb is not being applied and the drive waveform Vcom has an intermediate potential at the time of generation of the discharge timing pulse stb, the micro vibration operation is stopped. Then, after elapse of the delay time tDLY from the discharge timing pulse stb, the discharge pulse Pa is applied, and the micro vibration operation of applying the micro vibrating pulse Pb is again started.

In a case where the micro vibrating pulse Pb is being applied at the time of generation of the discharge timing pulse stb, the micro vibration operation is ended after the application of the micro vibrating pulse Pb completes and the drive waveform Vcom becomes an intermediate potential. Also in this case, the discharge pulse Pa is applied after elapse of the delay time tDLY from the discharge timing pulse stb. This is because the drive waveform Vcom changes sharply if the applied waveform is changed during application of the micro vibrating pulse Pb, which causes a discharge defect.

As described above, after application of the discharge pulse for discharging the liquid, the micro vibrating pulse is applied prior to the subsequent discharge timing. As a result, even when the linear speed of the linear object (e.g., the thread 101) is unstable and the head is driven with a variable discharge cycle, the state of the nozzle can be favorably maintained and stable discharge can be performed.

That is, for example, in the in-line embroidery machine as described above, the discharge cycle of the liquid from the head is proportional to the linear speed of the thread conveyed by the embroidery machine, but the linear speed of the thread conveyed by the embroidery machine is not necessarily constant.

Further, differences in linear speed are also large depending on the action of the embroidery machine. For example, when the action of the embroidery machine is "changing the embroidery position by the embroidery head", the linear speed of the thread is approximately five to ten times as fast as the linear speed of the thread in "embroidery operation" for sewing with the thread on the cloth.

As a result, the discharge cycle of the liquid is not constant. Additionally, when the discharge cycle is long, the liquid in or around the nozzle tends to thicken, and the possibility of a discharge defect increases. In addition, the maintenance operation (dummy discharge, flushing, etc.) for improving the discharge defect is performed with the conveyance of the thread stopped. Therefore, productivity is reduced if the maintenance operation is performed frequently.

In view of the foregoing, a micro vibrating pulse is applied to slightly vibrate the nozzle, thereby suppressing thickening of liquid in or around the nozzle.

Preferably, the delay time tDLY from the discharge timing pulse stb to the application of the discharge pulse Pa is equal to or longer than the waveform length of the micro vibrating pulse Pb. Such a configuration can prevent the occurrence of application timing of the discharge pulse Pa during application of the micro vibrating pulse Pb.

Further, preferably, the delay time tDLY is set to a sufficiently long time so that the discharge speed is not affected by the residual vibration by the micro vibrating pulse Pb. Then, the liquid can be discharged at a stable discharge speed.

The delay time tDLY can be a variable value.

Further, although the micro vibrating pulse (micro-vibration drive waveform) in the above embodiment is a micro-vibration drive waveform within the drive waveform, alternatively, a waveform exclusively for micro vibrating may be generated and used.

Further, since the micro vibration operation targets all the nozzles of all heads, the drive waveform application control may be configured as follows. In the micro vibration operation, instead of performing the above-mentioned mask control by the mask control signal MN, masking is turned off until the subsequent discharge timing.

Next, a description is given of an example of the relationship between the decapping time of the nozzle face of the head and the discharge stability in accordance with the micro vibration driving frequencies, with reference to FIG. 6.

The numerical values in the column of drive frequency in FIG. 6 are respectively "3": normal discharge, "2": discharge defect (e.g. landing position deviation) in nozzles of 10 channels or more per row, "1": omission of discharge in 10 channels or more per row.

In a structure using a liquid discharge head, the nozzle face is capped by a cap of the maintenance mechanism when the head is not driven to prevent thickening of the liquid in or around the nozzle due to drying, and the cap is removed from the nozzle face (decapping) when the head is driven. Since the nozzle face is decapped (exposed) at the time of liquid discharge, the thickening of liquid in the nozzle that does not discharge the liquid is prevented by the micro vibration operation, and the discharge stability is improved.

In general, the micro vibration cycle at the time of printing (image formation) is synchronized with the discharge timing signal stb. On the other hand, since the liquid discharge to the thread (textile printing) in the above-mentioned in-line embroidery machine starts from the start of the movement of the thread, the variations in the drive frequency are large (0 to several kHz). In addition, the frequency of the drive frequency bandwidth, which is large at the time of printing, is as low as several hundreds Hz. According to the results in FIG. 6, when the ambient temperature is 25 degrees centigrade, omission of discharge occurs in 2 minutes in a micro vibration cycle of 1 kHz, but normal discharge can continue for 6 minutes or longer in a micro vibration cycle of 10 kHz.

Therefore, a conceivable countermeasure is increasing the resolution of the encoder and raising the drive frequency, which is simple. Since the drive frequency increases in proportion to the resolution, the discharge stability is improved in the low frequency band of the drive frequency. However, the drive frequency increases in proportion to the resolution also in the high frequency band. Accordingly, such a countermeasure causes side effects. For example, the amount of heat generation of the head and the head driver drive circuit increase, and the discharge speed due to residual vibration changes in the high-frequency micro vibration operation.

Figure 7:
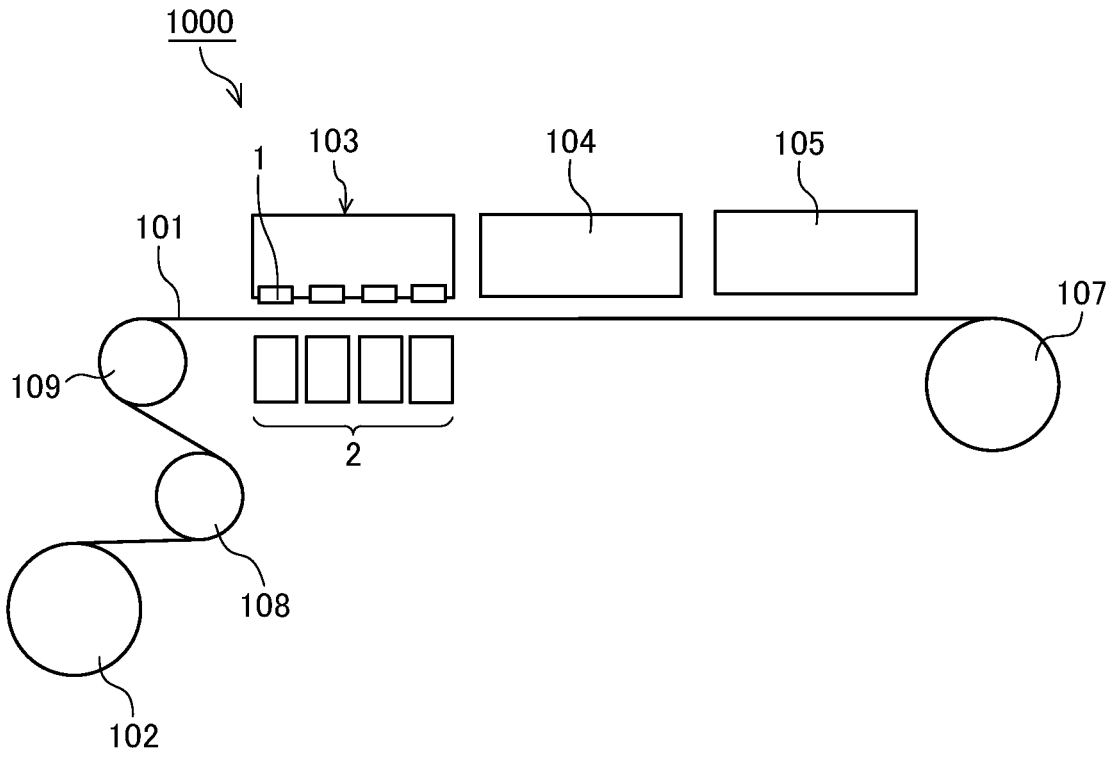
FIG. 7 is a schematic view of a dyeing apparatus according to an embodiment of the present disclosure.

A description is given below of a dyeing apparatus according to an embodiment of the present disclosure, with reference to FIG. 7. FIG. 7 is a schematic view of a dyeing apparatus 1000 according to another embodiment.

In the dyeing apparatus 1000, the embroidery head 106 in the liquid discharge apparatus 100 illustrated in FIG. 1 is replaced with a take-up reel 107 for winding the thread 101 after dyeing.

The dyeing apparatus 1000 supplies the thread 101 from the supply reel 102, discharges a liquid of a required color from the liquid application unit 103, dyes the thread 101 into a target color, and winds the dyed thread 101 with the take-up reel 107.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a head including a row of a plurality of nozzles configured to discharge a liquid;

circuitry configured to:

generate a discharge timing in accordance with movement of a linear object to which the head applies the liquid;

apply a drive waveform to the head based on the discharge timing; and apply a micro vibrating pulse to the head after application of a discharge pulse for discharging the liquid and before a subsequent discharge timing, the micro vibrating pulse for vibrating a meniscus of the nozzle, wherein the circuitry is configured to continue application of the micro vibrating pulse at predetermined time intervals until the subsequent discharge timing.

2. The liquid discharge apparatus according to claim 1, wherein the circuitry is configured to generate the discharge timing each time an amount of movement of the linear object reaches a predetermined amount.

3. A dyeing apparatus comprising:

a head including a row of a plurality of nozzles configured to discharge a liquid;

circuitry configured to:

generate a discharge timing in accordance with movement of a linear object to which the head applies the liquid;

apply a drive waveform to the head based on the discharge timing; and apply a micro vibrating pulse to the head after application of a discharge pulse for discharging the liquid and before a subsequent discharge timing, the micro vibrating pulse for vibrating a meniscus of the nozzle, wherein the circuitry is configured to continue application of the micro vibrating pulse at predetermined time intervals until the subsequent discharge timing.

4. A method for applying a drive waveform to a head including a row of a plurality of nozzles for discharging a liquid, the method comprising:

generating a discharge timing in accordance with movement of a linear object to which the head applies the liquid;

applying a drive waveform to the head based on the discharge timing; and applying a micro vibrating pulse to the head after application of a discharge pulse for discharging the liquid and before a subsequent discharge timing, the micro vibrating pulse for vibrating a meniscus of the nozzle, wherein the applying the micro vibrating pulse continues application of the micro vibrating pulse at predetermined time intervals until the subsequent discharge timing.

5. The liquid discharge apparatus according to claim 1, wherein the circuitry is configured to apply the micro vibrating pulse repeatedly until the subsequent discharge timing.

6. The dyeing apparatus according to claim 3, wherein the circuitry is configured to apply the micro vibrating pulse repeatedly until the subsequent discharge timing.

7. The method according to claim 4, wherein:

the applying the micro vibrating pulse repeatedly applies the micro vibrating pulse until the subsequent discharge timing.

* * * * *